United States Patent [19]

Griffiths

[11] Patent Number: 4,622,696

[45] Date of Patent: Nov. 18, 1986

[54] UNDER HELMET HOOD FOR AIRCREW

[76] Inventor: Joseph A. Griffiths, Mid Trees, Wood Road, Hindhead, Surrey, England

[21] Appl. No.: 632,583

[22] Filed: Jul. 19, 1984

[30] Foreign Application Priority Data

Oct. 31, 1983 [GB] United Kingdom ..... 8329024

[51] Int. Cl.[4] ..... A42B 3/00

[52] U.S. Cl. ..... 2/6; 2/424; 2/425

[58] Field of Search ..... 2/6, 9, 424, 425

[56] References Cited

U.S. PATENT DOCUMENTS

| | | | |
|---|---|---|---|
| 2,935,985 | 5/1960 | Andrews et al. | 2/424 X |
| 3,220,408 | 11/1965 | Silverberg | 2/424 X |
| 3,362,403 | 1/1968 | Fleming et al. | 2/6 X |
| 3,438,060 | 4/1969 | Lobelle et al. | 2/6 |
| 4,070,712 | 1/1978 | Marwitz | 2/424 X |
| 4,475,248 | 10/1984 | L'Abbe et al. | 2/424 X |

*Primary Examiner*—Louis K. Rimrodt

*Attorney, Agent, or Firm*—Wolf, Greenfield & Sacks

[57] ABSTRACT

An under helmet hood for aircrew which has a butyl rubber cowl (1) and, severed but in no way displaced therefrom, a face mask portion which includes a face mask (2) having a fixed vizor (3). The perfect butt joint remaining in the butyl rubber between the cowl (1) and the face mask portion is covered by a longitudinally grooved neoprene strip (5), glued in position during manufacture before the cowl is severed, having a rip toggle arrangement which enables tearing of the strip along its groove (9) to be initiated. The face mask portion is then readily ripped out by further tearing of the strip along its groove and separation of the face mask portion at the butt joint. The invention enables reliable protection against all NBC agents and yet at the same time affords excellent rip off facility.

20 Claims, 4 Drawing Figures

UNDER HELMET HOOD FOR AIRCREW

This invention relates to an under helmet hood for use by aircrew.

Under helmet hoods are used in conjunction with breathing equipment to protect the user against nuclear biological and chemical (NBC) agents. One known hood has a cowl of neoprene, and incorporates a face mask including a fixed vizor and front assembly adapted to house the oxygen breathing mask and microphone. One design criterion for such a hood is that the rubber from which it is made, if it is to be able to protect the aircrew from the NBC agents, must be capable of withstanding the shock or forces generated on ejection from an aircraft. Known neoprene hoods are made of a material of sufficient thickness to do this.

However, in case of emergencies, the aircrew wish to be able to remove the face mask quickly, for instance if they are about to land in the sea. The known neoprene hood has therefore been provided with a toggle arrangement which the aircrew can pull in order to tear the cowl and provide a hole therein. The aircrew can then put his hand into that hole and rip out the whole of the rigid face mask assembly. This is made extremely easy because neoprene tears cleanly and quickly along a fairly predictable line. Whilst known neoprene hoods have been found to be fairly satisfactory in the past, they do not have the required degree of chemical resistance to certain NBC agents now available and therefore another material has had to be found which would meet all the required standards. One material now used is the butyl rubber range of materials, i.e. butyl, bromobutyl or chlorobutyl rubber. Whilst this material resists the up to date NBC agents, it does cause considerable difficulties with regard to providing the tear off facility for the face mask, because a butyl rubber does not tear readily. It was found that the toggle arrangement used on the known neoprene cowl could be used, but this would only provide the aircrew with an initial hole to give him access to the face mask. When he tried to tear out the face mask, the butyl would not tear cleanly. This arrangement was therefore not satisfactory.

Several solutions to this problem have been tried but without complete success. First of all, it was attempted to perforate the cowl around the face mask and then cover this perforated line with a neoprene strip. This proposal does not work satisfactorily because the butyl will tear along the initial perforation, but then the tear will not cross over the material between the perforations.

The second solution tried was to attach a nylon cord round the face mask by means of stitching. This system was not acceptable because the NBC agents could penetrate the stitch holes.

A third proposal has been to completely cut out the face mask and then replace it in the cowl, retaining it in position using a neoprene strip with a rip off toggle attached to it. This solutio has found moderate success but it is extremely difficult to manufacture because of the difficulty of exactly reassembling and realigning the cut out face mask in the butyl cowl. Unless a perfect butt joint in obtained, some NBC agents can penetrate the neoprene strip through to the interior of the hood, because the joint in the butyl cowl is not providing an absolute seal.

The present invention overcomes the above-described problem using an improved neoprene strip and improved method and means of utilisation thereof.

In the present invention, the neoprene strip is formed along its centre line on one side with a groove. Preferably this is V-shaped but any other suitable configuration could be used. The neoprene strip is then glued to the cowl around the face mask portion which is to be provided with the rip off facility. The rip off toggle is normally provided on the right hand side of the face mask, in which case the neoprene strip is first of all attached at the bottom of the face mask and glued round in an anti-clockwise direction until it returns to the start point, where it is overlapped. The rip off toggle is then glued to the neoprene strip and the hood is turned inside out. The moulded groove in the neoprene strip can, in part due to the gluing of said strip to the cowl, be seen as a witness line through the butyl cowl, and the cowl can be cut using a hooked knife thereby providing a perfect and undisturbed butt joint in the cowl, which joint is covered by the uncut neoprene strip. Thus, when the rip off toggle is pulled, the neoprene strip will tear along the moulded groove initially to provide a hole in the butyl cowl at the right hand side of the mask, into which the aircrew can insert his left hand to grip the rigid face mask and pull it away from the butyl cowl, which tears along the moulded groove in the neoprene strip and separates at the butt joint beneath it.

A preferred embodiment of the invention will now be described by way of example only, with reference to the accompanying diagrammatic drawings in which.

Figure 1:
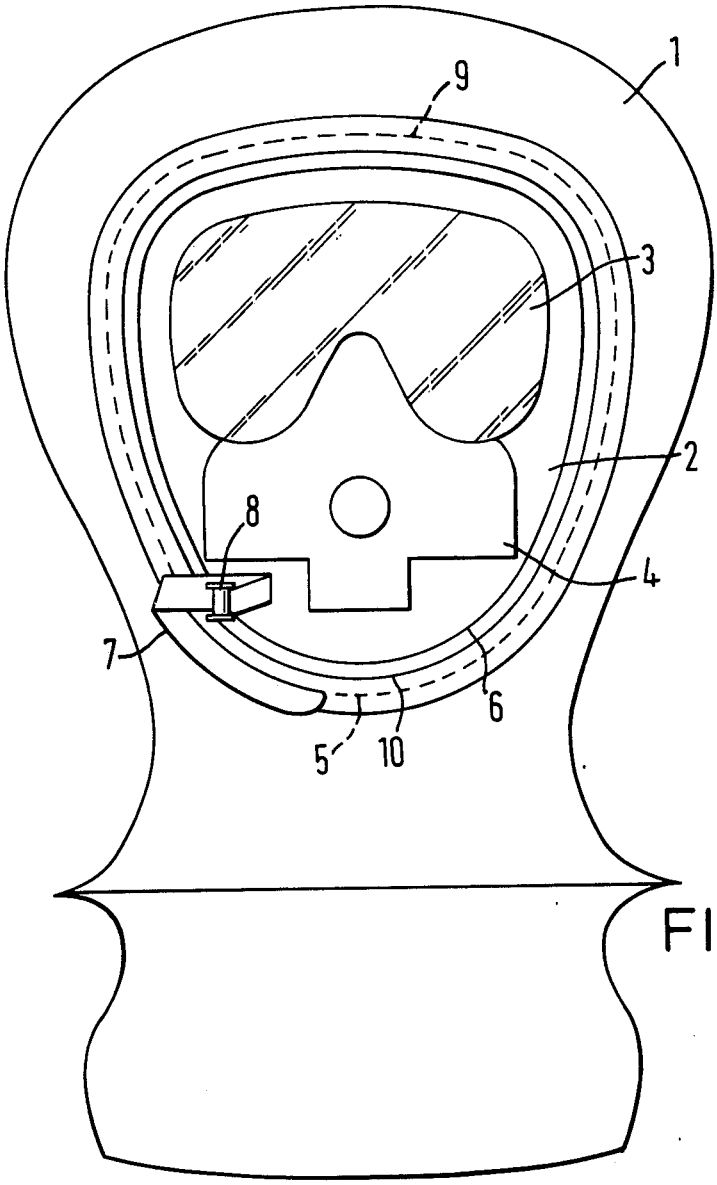
FIG. 1 is a front schematic view of an under helmet hood provided with a rip off facility in accordance with the present invention.
Figure 2:
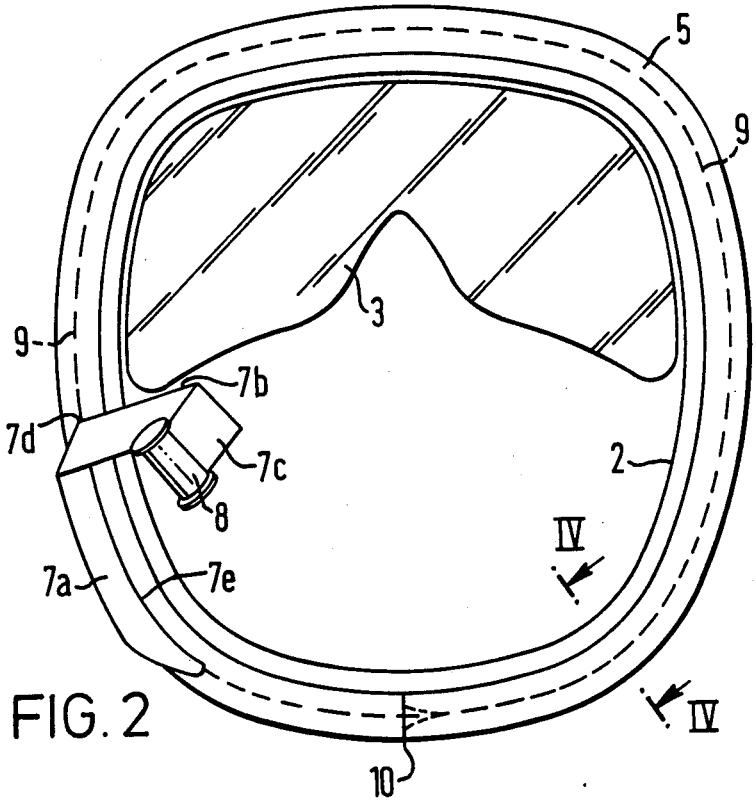
FIG. 2 is an enlarged view of the rip off portion of the hood shown in FIG. 1.

Turning now to the drawings, there is shown in FIG. 1 a hood having a cowl 1 moulded from a butyl rubber material such as butyl, bromo-butyl or chlorobutyl rubber. A rigid face mask 2 moulded from a polycarbonate material and incorporating fixed vizor 3 is attached and sealed to the cowl 1 along the line 6. Closely surrounding the face mask 2 is a neoprene strip 5, which is about 12 mm wide. A rip off toggle 7 is glued to the neoprene strip on the right hand side of the face mask, as indicated in FIGS. 1 and 2.

The illustrated rip off face mask works as follows. If an aircrew has ejected from his aircraft and is coming down, for instance into the sea, in his deployed parachute, he would wish to remove the face mask. To do this, he pulls the rip off toggle 7 by means of its tab 8, which immediately causes the strip 5 to tear in the region of the toggle and create a large hole. The aircrew then inserts his left hand in the hole and rips the face mask 2 away from the cowl 1 by causing it to tear along the line of the strip 5.

As already explained, the difficulty with butyl rubber materials is that they will not tear readily. It is necessary therefore to provide some form of preformed path to encourage the cowl 1 to tear along this predetermined path. In the illustrated hood, this has been achieved by moulding the neoprene strip 5 with a longitudinal, central V-shaped groove 9. The grooved strip 5 is attached to the cowl 1 in an anti-clockwise direction just outside the rigid face mask 2, and it is overlapped at the start position 10 (see FIG. 2). The rip off toggle 7 is made from a cloth reinforced plastics or rubber material having a tear portion *7A*, a folded over portion *7b* and a tab portion *7C* to which the actual toggle 8 is attached. By folding the portion *7B* at right angles or at least laterally with respect to the portion *7a*, a pointed corner *7D* is formed the significance of which will be explained later. The portio *7A* is glued on to the rip off strip 5 with its inside edge *7E* aligned along the groove 9. Importantly, the corner *7D* is aligned with the groove 9 in the rip strip. The portion *7B* is touch glued to the face mask 2, the corner *7D* being touch glued to the strip 5 in alignment with the groove 9, and the portion *7C* with the toggle 8 attached to it is then reverse folded as illustrated.

Figure 4:
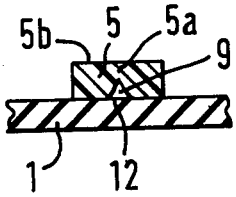
FIG. 4 is a cross section through FIG. 2 along the line 4—4, but to an enlarged scale.

The hood is now turned inside out. Partly owing to the gluing of the strip 5 to the cowl 1, the line of the groove 9 in the strip 5 can be seen through the thickness of the cowl material, and serves as a witness line (see FIG. 4) enabling the butyl cowl 1 to be cut along the groove at 12, thus defining and forming a face mask portion, i.e. the face mask together with a narrower peripheral border of cowl material. The cut along 12 is effected with a knife having a rounded, hooked end, or scissors whereby damage to the grooved strip 5, and cutting thereof in particular, is readily avoided. Most importantly, the face mask portion is only severed; it is not pulled away or in any way displaced relative to the cowl, so that a perfect butt joint 12 remains, between the face mask portion and the cowl, after severing has been effected. This perfect butt joint ensures that excellent protection against all NBC agents is ensured, by means of a virtually continuous butyl rubber layer, and regardless of any deficiencies in protection offered by the neoprene material forming the strip 5 or the glue used to secure the strip to the cowl 1. The hood can now be turned so that the strip 5 is again on the outside.

Figure 3:
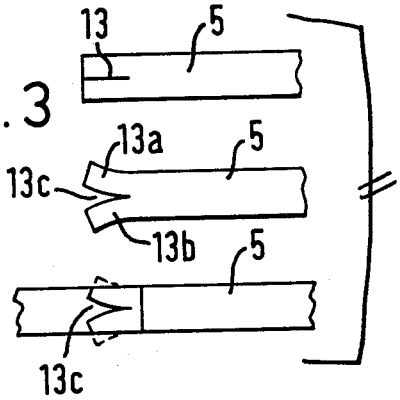
FIG. 3 shows the method of starting and finishing the assembly of the neoprene strip shown in FIGS. 1 and 2.

As above explained, the strip 5 has been attached to the cowl 1 in an anti-clockwise direction starting from the start point 10. The start of the strip 5 is provided with a cut 13 which is opened out into two arms 13*A* and 13*B* and stuck to the cowl at the location 10. The remainder of the strip is then stuck to the hood around the face mask 2 until the location 10 is again reached, whereupon it is overlapped, as shownin FIG. 3. The excess material from the portions 13*A* and 13*B* is then trimmed, as indicated in dotted line, to provide a neater appearance. The provision of the opened-out portion 13*C* is important to ensure continued tearing of the neoprene strip 5 as the face mask is being ripped off. It will be appreciated that, on pulling the toggle 8 away from the face mask 2, the corner *7D* starts the strip 5 tearing along the line 9. As the toggle 8 is pulled down, the strip 5 tears along the groove 9 and a hole in the hood is formed. The aircrew can then insert his left hand in this hole and grip the face plate 2 and tear it in a direction diagonally away from the hole which has been formed. As he does this, the neoprene, which rips very easily, tears along the groove 9. When it reaches the start portion 10, it can easily continue to tear along the groove 9 because of the opened-out portion 13*C*. It will be appreciated that the face mask is able to be removed from the butyl cowl 1 because it has already been separated therefrom during manufacture by cutting along the line 12, which is located directly beneath the groove 9 in the neoprene strip 5.

The improved step in the manufacture or assembly of the hood with the rip off face mask is that, in contrast to the known method where the face mask is cut and pulled out of the cowl prior to the application of a plain neoprene strip, in the present invention the strip 5 with its moulded groove 9 is stuck round the cowl just outside the face mask first. It is this step that enables the face mask to be cut out from the cowl 1 along the line 12, in simple fashion, using a sharp knife, the groove 9 on the reverse side of the strip 5 providing the abovementioned witness line which can be followed by the person using the knife. This in turn ensures that the face mask is maintained in position relative to the rest of the hood through the perfect butt joint 12.

A preferred neoprene strip is about 0.75 mm thick (say between 1.00 and 0.50 mm thickness). The thickness of the portion 5A between the bottom of the groove 9 and the outer strip surface 5*B* is critical to the operational capabilities of the hood because the thickness of the material 5*A* must be such that it can withstand the ejection velocity from the aircraft without rupturing, yet still be capable of being easily torn by the aircrew to remove the face mask. A preferred thickness of the portion 5*A* is about 0.25 to 0.50 mm, but this dimension may be varied, generally from one sixth to one third of the total strip thickness, depending on the operational characteristics required.

With this improved tear off arrangement, it is possible to remove the mask in not more than 3 seconds, which gives the aircrew the rip out facility which is required.

I claim:

1. An under helmet hood for aircrew comprising a head cowl which is made of an NBC resistant but relatively non-tearable rubber material, a relatively rigid face mask incorporating an optical vizor, and rip-out means enabling a portion carrying the face mask to be ripped out of the cowl in an emergency, said means including a longitudinally grooved strip of rubber material which is readily tearable along its groove and which extends around the cowl just outside the face mask to cover in alignment with its groove an exact butt joint formed between the cowl and the face mask portion which is to be able to be ripped out.

2. A hood according to claim 1, wherein the said exact butt joint has been formed by cutting through the cowl to form the required face mask portion, without causing any displacement of said face mask portion relative to the cowl.

3. A hood as claimed in claim 1 or claim 2, wherein the cowl is made of a butyl rubber and the grooved strip is made of a neoprene rubber.

4. A hood as claimed in claim 1, wherein the rip-out means includes a toggle arrangement for starting a tear along the groove in the strip.

5. A hood according to claim 4, in which the toggle arrangement includes a tab so attached to the main portion of the toggle that, when gripped and pulled, a tearing strain is applied to the strip along and in line with the groove therein at one end of said strip.

6. A hood according to claim 5, wherein the tab is attached to the main portion of the toggle through a corner formed by a fold in the toggle, which corner is glued to the strip in alignment with the groove therein.

7. A hood according to claim 1 wherein the said groove is a groove open on the face of the strip lying against the surface of the cowl.

8. A hood according to claim 7, wherein the said groove is a V-groove.

9. A hood according to claim 1 wherein the depth of thickness of the strip beneath said groove is between one third and one sixth of the total thickness of the strip.

10. A hood according to claim 9, wherein the strip is of the order of 1.00 to 0.50 mm thick.

11. A hood according to claim 1 wherein the strip overlaps itself lengthwise around the periphery of the face mask.

12. A hood according to claim 11, wherein the overlapped end portion of the strip is split or opened out along the groove to facilitate continued tearing of the strip into and along said end portion.

13. A hood according to claim 11 wherein the strip overlap is provided generally at the bottom of the periphery of the face mask and the toggle arrangement is provided on one side of the periphery of the face mask.

14. A tearable strip for use as a rip-out means in an underhood for aircrew, comprising a strip; of longitudinally grooved rubber material readily tearable along its groove, together with a toggle arrangement bondable or bonded to the strip for facilitating tearing of the strip along its groove.

15. A strip according to claim 14, wherein said strip is made of neoprene rubber.

16. A strip according to claim 14 or claim 15, wherein said groove is a V-groove.

17. A strip according to claim 14 wherein said toggle arrangement is bonded to the opposite face of the strip to that having the longitudinal groove.

18. A strip according to claim 14 being of the order of 1.00 to 0.50 mm thickness with a depth of thickness beneath the groove of between one third and one sixth of the total strip thickness.

19. A method of producing an underhelmet for aircrew, comprising the steps of forming an integrated flexible cowl and relatively rigid face mask of NBC agent resistant but relatively non-tearable materials, bonding a longitudinally grooved strip of relatively flexible rubber material to the exterior of the cowl around the periphery of the face mask, with the groove on the inside, turning the hood inside-out, and severing a face mask portion in the cowl, without cutting the strip and using the groove in the strip as a witness line.

20. A method according to claim 19, wherein the cowl and facemask are produced by moulding of a butyl rubber and a polycarbonate, respectively, while the grooved strip is produced of a neoprene rubber.

* * * * *